US007093692B2

(12) United States Patent
Koura

(10) Patent No.: US 7,093,692 B2
(45) Date of Patent: Aug. 22, 2006

(54) DOOR CONTROL DEVICE OF ELEVATOR

(75) Inventor: Kunikazu Koura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 383 days.

(21) Appl. No.: 10/478,053

(22) PCT Filed: Jun. 28, 2002

(86) PCT No.: PCT/JP02/06594

§ 371 (c)(1),
(2), (4) Date: Nov. 18, 2003

(87) PCT Pub. No.: WO2004/002869

PCT Pub. Date: Jan. 8, 2004

(65) Prior Publication Data

US 2004/0159500 A1 Aug. 19, 2004

(51) Int. Cl.
*B66B 13/14* (2006.01)

(52) U.S. Cl. ..... 187/316; 49/28

(58) Field of Classification Search ..... 187/316, 187/317, 391–394; 49/26–28, 118; 318/280–286, 318/466–470, 480

See application file for complete search history.

(56) References Cited

U.S. PATENT DOCUMENTS 4,621,452 A 11/1986 Deeg
6,631,788 B1 10/2003 Shika et al.
6,962,239 B1 * 11/2005 Shikai et al. ..... 187/316

FOREIGN PATENT DOCUMENTS

| | | |
|---|---|---|
| JP | 53-49868 (U) | 4/1978 |
| JP | 1-285580 | 11/1989 |
| JP | 7-97167 | 4/1995 |
| JP | 8-40677 | 2/1996 |
| JP | 8-259157 | 10/1996 |
| JP | 8-259158 | 10/1996 |
| JP | 63-66084 | 3/1998 |
| JP | 10-139333 | 5/1998 |
| JP | 10-265157 | 10/1998 |
| JP | 11-310375 | 11/1999 |
| JP | 11-343087 | 12/1999 |
| JP | 2003-40562 | 2/2003 |

* cited by examiner

*Primary Examiner*—Jonathan Salata
(74) *Attorney, Agent, or Firm*—Leydig, Voit & Mayer, Ltd.

(57) ABSTRACT

An elevator door control device includes an obstruction sensor adapted to detect an obstruction in the vicinity of any one of the vertical frames of the doorway frame and to output an obstruction detection signal, and a door control unit for controlling door opening operation and door closing operation of a car door and a landing door in response to the obstruction detection signal. The obstruction sensor has light emitters provided on the vertical frames of the doorway frame and light receivers provided on the upper frame of the doorway frame. The light emitters are provided in the vicinity of the lower ends of the vertical frames and emit detection lights substantially along the vertical frames. The light receivers are provided on the lower surface of the upper frame and receive the detection lights.

10 Claims, 5 Drawing Sheets

DOOR CONTROL DEVICE OF ELEVATOR

TECHNICAL FIELD

This invention relates to an elevator door control device for controlling opening/closing operations of a car door for opening and closing a car doorway, and opening/closing operations of a landing door for opening and closing a landing doorway.

BACKGROUND ART

For example, Japanese Utility Model Application Laid-open No. Sho 53-49868 discloses a conventional elevator door safety device in which two light emitters are arranged on an upper frame of a landing three-way frame and in which two light receivers are arranged on vertical frames of the landing three-way frame. Detection lights emitted from the two light emitters cross each other at the center of a landing doorway and are received by the light receivers. When the detection lights are intercepted by an obstruction, such as a passenger, during door closing operation, the operating directions of the landing door and the car door are reversed, thereby preventing the obstruction from being caught between the doors.

While the above-described safety device is capable of preventing an obstruction from being caught between the doors during door closing operation, it is not capable of preventing the obstruction from being caught between a door and a doorway frame during door opening operation.

In this regard, JP 10-139333 A, for example, discloses a conventional device for protecting passengers from getting caught, in which a light emitter is arranged on one side of the car doorway or of the landing doorway and in which a light receiver is arranged on the other side thereof. Detection light is emitted horizontally from the light emitter along the door surface and is received by the light receiver. When the detection light is intercepted by an obstruction during door opening operation, the door operating direction is reversed, thereby preventing the obstruction from being caught between the door and the doorway frame.

The above-described device for protecting passengers from getting caught has a problem in that the door opening operation is reversed not only when the obstruction is near the vertical frame of the doorway frame but also when the obstruction is at the center of the doorway. That is, the door opening operation is reversed whenever the obstruction is situated in the vicinity of the door. Further, to secure the requisite accuracy in detection, it is necessary to arrange a large number of light emitters and light receivers in the vertical direction of the doorway.

JP 11-310375 A discloses a conventional door safety device in which a light emitter and a light receiver are arranged in a door case portion between the vertical frame of the doorway frame and the door. That is, the light emitter is arranged on an upper portion of the vertical frame, and the light receiver is arranged on a lower portion of the vertical frame. Detection light from the light emitter is emitted vertically downwards along the vertical frame and is received by the light receiver.

The problem with the above door safety device is that the detection light is intercepted only after the obstruction has been caught in the door case portion, which means it is impossible to prevent the obstruction from being caught.

DISCLOSURE OF THE INVENTION

This invention has been made in view of the above problems in the prior art. It is an obstruction of this invention to provide an elevator door control device capable of more reliably preventing an obstruction from being caught between the doorway frame and the door.

To this end, according to one aspect of the present invention, there is provided an elevator door control device for use in an elevator apparatus of a type in which a doorway frame having a pair of vertical frames and an upper frame provided between the vertical frames is provided in each of a car doorway and a landing doorway, opening/closing operations of a car door for opening and closing the car doorway and opening/closing operations of a landing door for opening and closing the landing doorway being controlled by the elevator door control device, comprising: an obstruction sensor which has a light emitter provided on one of the vertical frame and the upper frame of at least one of the car doorway and the landing doorway and adapted to emit a detection light substantially along the vertical frame, and a light receiver provided on the other of the vertical frame and the upper frame and adapted to receive the detection light, and which is adapted to detect any obstruction in the vicinity of the vertical frame to output an obstruction detection signal; and a door control unit for controlling the opening/closing operations in accordance with the obstruction detection signal.

According to another aspect of the present invention, there is provided an elevator door control device for use in an elevator apparatus of a type in which a doorway frame having a pair of vertical frames and an upper frame provided between the vertical frames is provided in each of a car doorway and a landing doorway, opening/closing operations of a car door for opening and closing the car doorway and opening/closing operations of a landing door for opening and closing the landing doorway being controlled by the elevator door control device, comprising: an obstruction sensor for detecting an obstruction in the vicinity of the vertical frame of at least one of the car doorway and the landing doorway to output an obstruction detection signal; an alarm device for issuing an alarm for a passenger; and a door control unit for controlling the opening/closing operations in accordance with the obstruction detection signal, wherein the door control unit, when it receives the obstruction detection signal prior to the start of the door opening operation, causes the alarm device to issue an alarm before starting the door opening operation.

According to a still further aspect of the present invention, there is provided an elevator door control device for use in an elevator apparatus of a type in which a doorway frame having a pair of vertical frames and an upper frame provided between the vertical frames is provided in each of a car doorway and a landing doorway, opening/closing operations of a car door for opening and closing the car doorway and opening/closing operations of a landing door for opening and closing the landing doorway being controlled by the elevator door control device, comprising: an obstruction sensor for detecting an obstruction in the vicinity of the vertical frame of at least one of the car doorway and the landing doorway to output an obstruction detection signal; and a door control unit for controlling the opening/closing operations in accordance with the obstruction detection signal, wherein the door control unit, when it receives the obstruction detection signal during the door opening operation, stops the door opening operation temporarily.

According to a still further aspect of the present invention, there is provided an elevator door control device for controlling opening/closing operations of a car door for opening and closing a car doorway and opening/closing operations of a landing door for opening and closing a landing doorway, comprising: a door load detecting device adapted to output an excessive load detection signal when the load at the time of opening/closing the car door and the landing door exceeds a pre-set value; and a door control unit adapted to control the opening/closing operation and to reverse the operating directions of the car door and the landing door upon receiving the excessive load detection signal, wherein the door control unit, when it receives the excessive load detection signal during door opening operation, counts the number of times that the excessive load detection signal has been input before the completion of the opening/closing operation, interrupting the opening/closing operation and outputting an abnormality detection signal when the number of times of input reaches a pre-set number.

BEST MODE FOR CARRYING OUT THE INVENTION

Preferred embodiments of this invention will hereinafter be described with reference to the drawings.

EMBODIMENT 1

Figure 1:
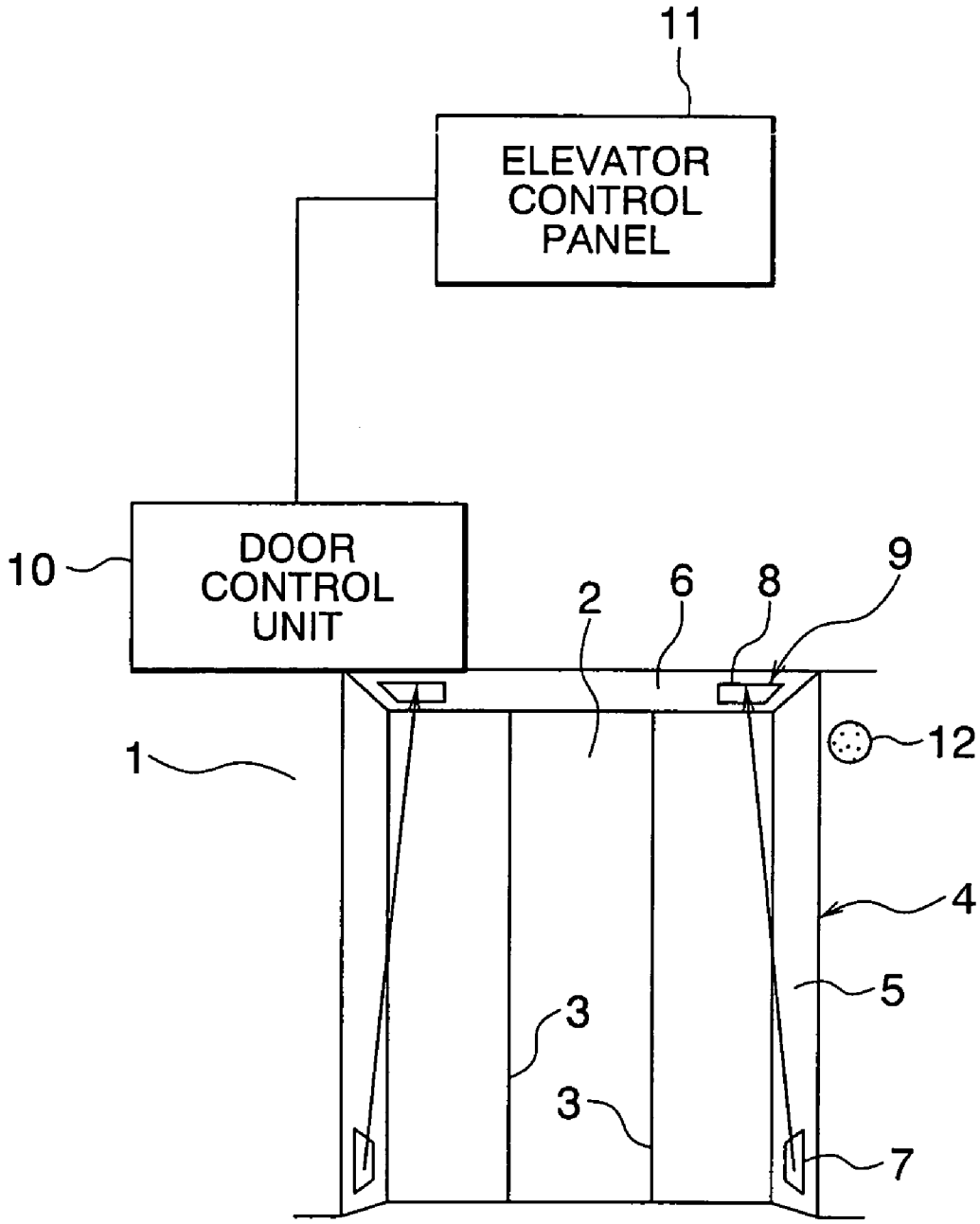
FIG. 1 is a schematic diagram showing a construction of a main portion of an elevator door control device according to Embodiment 1 of this invention.

FIG. 1 is a schematic diagram showing the construction of a main portion of an elevator door control device according to Embodiment 1 of this invention. In the drawing, a car (car chamber) 1 is equipped with a car doorway 2. The car doorway 2 is opened and closed by a pair of car doors 3. A doorway frame 4 is fixed to the edge portion of the car doorway 2. The doorway frame 4 has a pair of vertical frames 5 extending in the vertical direction and an upper frame 6 which is provided between upper ends of the vertical frames 5 and extends in the horizontal direction.

Light emitters 7 for emitting detection lights substantially along the vertical frames 5 (as indicated by arrows in FIG. 1) are embedded in the portions of the opposing side surfaces of the vertical frames 5 which are in the vicinity of lower ends of the vertical frames 5. Embedded on the lower surface of the upper frame 6 are a pair of light receivers 8 for receiving detection lights (beams) from the light emitters 7. The light receivers 8 are arranged in the vicinity of the ends with respect to the width direction of the car doorway 2. An obstruction sensor 9 includes the light emitters 7 and the light receivers 8, and is adapted to detect any obstructions (not shown) in the vicinity of the vertical frames 5, outputting an obstruction detection signal.

A door motor (not shown) for driving the car doors 3 is controlled by a door control unit 10. That is, door opening operation and door closing operation of the car doors 3 and of landing doors (not shown) opened and closed in synchronism with the car doors 3 are controlled by the door control unit 10. Further, obstruction detection signals from the obstruction sensors 9 are input to the door control unit 10.

The door control unit 10 is connected through a communication line to an elevator control panel 11 for controlling ascent and descent of the car 1. A door opening command signal and a door closing command signal that are output from the elevator control panel 11 are input to the door control unit 10. That is, in response to the door opening command signal and the door closing command signal from the elevator control panel 11, the door control unit 10 starts to control the door opening operation and the door closing operation.

Mounted in the door control unit 10 and the elevator control panel 11 are microprocessors (CPUs) for performing control operation, ROMS storing operation programs for the CPUs, RAMs storing operation data, etc. of the CPUs, and interfaces for performing input and output to and from the exterior.

Further, installed in the car 1 is an alarm device (announcing device) 12 for giving an alarm to a passenger. The alarm includes an attention call announcement, and an alarm sound such as a buzzer sound.

Figure 2:
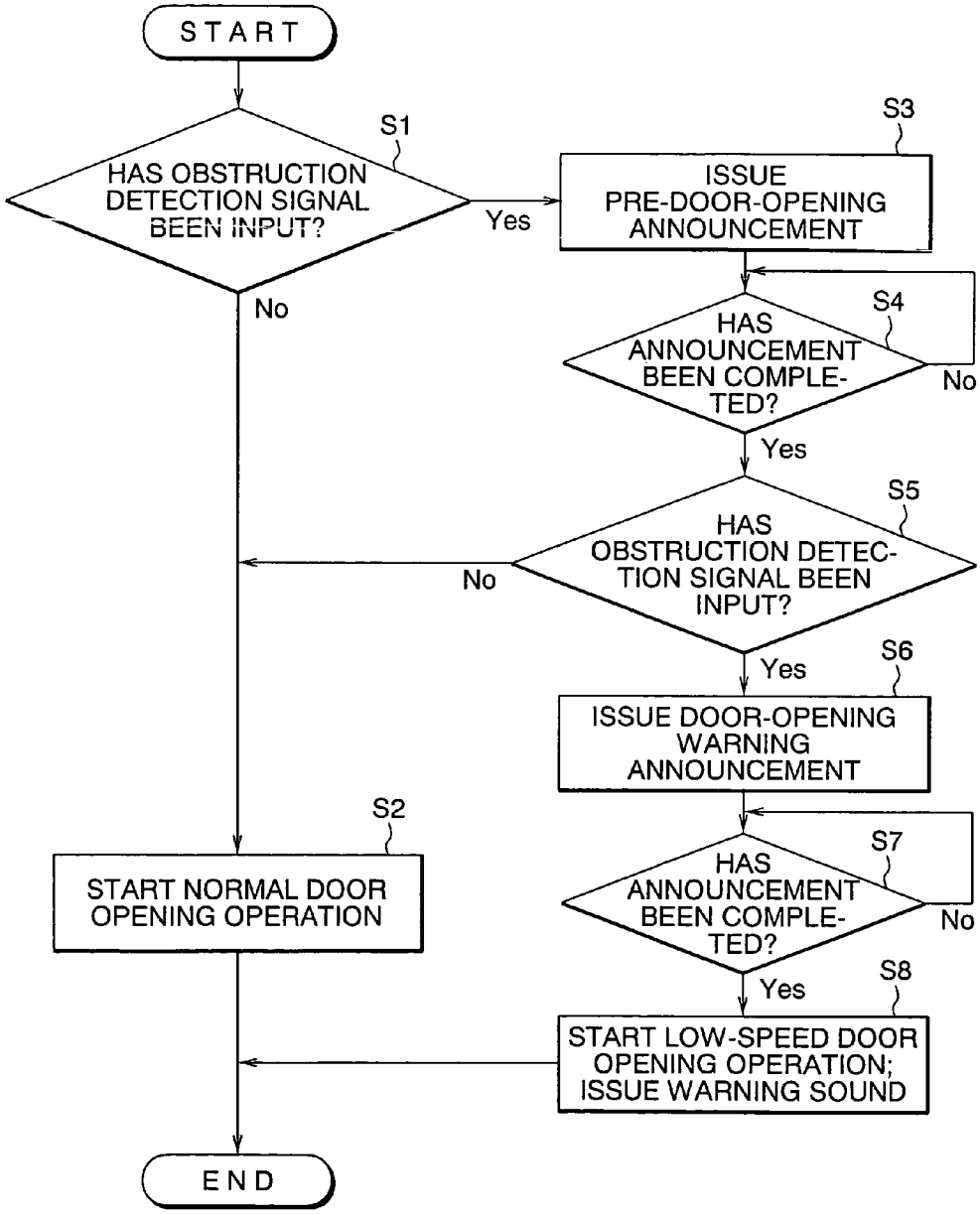
FIG. 2 is a flowchart illustrating a control process to be performed prior to door opening operation by the door control device of FIG. 1.

Next, the operation of the device of this embodiment will be described. FIG. 2 is a flowchart illustrating the control process to be performed by the door control device of FIG. 1 prior to the start of door opening operation. When the car 1 stops at a destination floor and a door opening command signal is output from the elevator control panel 11 to the door control unit 10, a judgment is made as to whether an obstruction detection signal has been input from any one of the obstruction sensors 9 (step S1). The obstruction sensors 9 may be operated only when the door opening command signal has been generated or may be constantly kept in operation. When no obstruction detection signal has been input, door opening operation is started at normal speed (step S2).

When the obstruction detection signal has been input, a pre-door-opening attention announcement is issued from the alarm device 12 (step S3). The pre-door-opening attention announcement may, for example, be the message as follows: "The door is opening. Please keep off the door."

After the completion of the pre-door-opening attention announcement (step S4), a judgment is made again as to whether an obstruction detection signal has been input from any one of the obstruction sensors 9 (step S5). If, at this stage, no obstruction detection signal has been input, the door opening operation is started at normal speed (step S2).

When, despite the issuance of the pre-door-opening attention announcement, an obstruction detection signal has been input, a door opening warning announcement is issued from the alarm device 12 (step S6). The door opening warning announcement may, for example, be the message as follows: "The door is opening".

After the completion of the door opening warning announcement (step S7), door opening operation is started at a speed lower than a normal door opening speed (step S8). At this time, a door opening warning sound, such as a buzzer sound or a chime sound, is issued from an alarm device 12.

Figure 3:
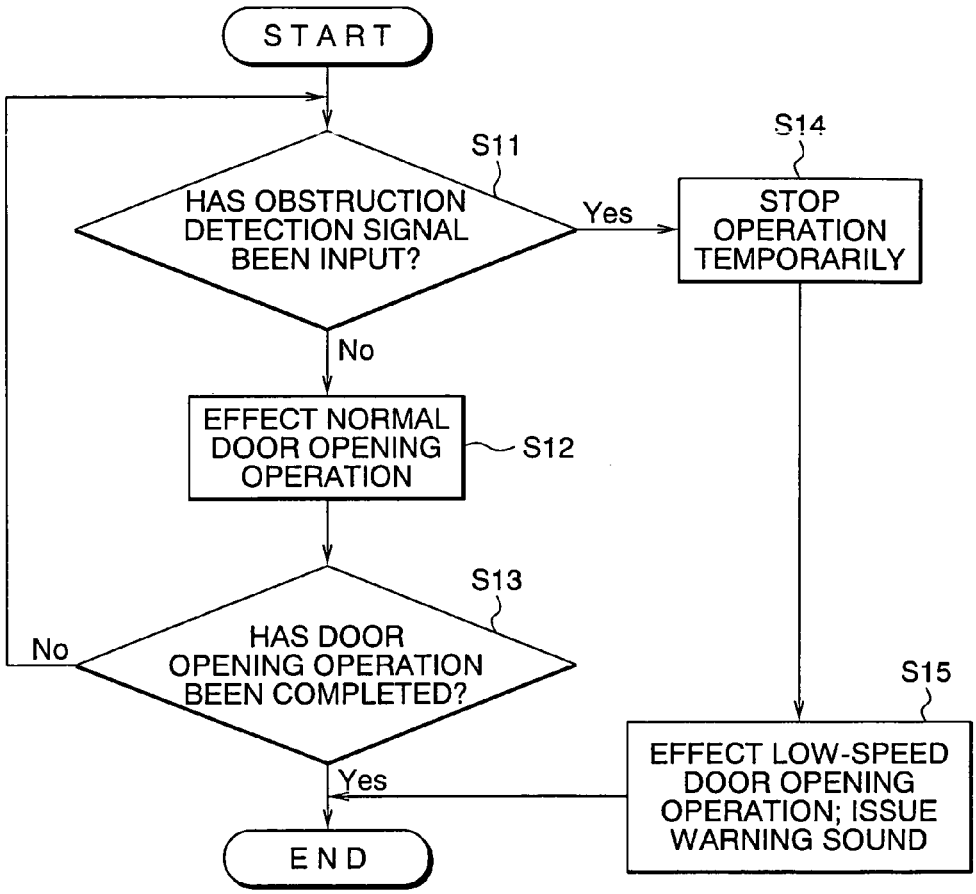
FIG. 3 is a flowchart illustrating a control process to be performed during door opening operation by the door control device of FIG. 1.

Next, FIG. 3 is a flowchart illustrating the control process to be performed by the door control device of FIG. 1 during door opening operation. Normally, during door opening operation, a judgment is made as to whether an obstruction detection signal has been input from any one of the obstruction sensors 9 (step S11). If no obstruction detection signal has been input, normal door opening operation is continued (step S12). Then, a judgment is made as to whether the door opening operation has been completed or not (step S13). If it has not been completed yet, checking on the input of an obstruction detection signal is continued (step S11).

When an obstruction detection signal is input during normal door opening operation, the door opening operation is temporarily stopped for a pre-set period of time (e.g., three seconds) (step S14). After the temporary stopping of the door opening operation, the door opening operation is resumed at a speed lower than a normal door opening speed (step S15). At this time, a door opening warning sound, such as a buzzer sound or a chime sound, is issued from the alarm device 12.

In this elevator door control device, the light emitters 7 are arranged on the vertical frames 5 and the light receivers 8 are arranged on the upper frame 6, with the detection lights being emitted substantially along the vertical frames. Therefore, it is possible to prevent an obstruction from being caught between the vertical frame 5 and the car door 3 during the door opening operation. Further, since no obstruction is detected at the center of the car doorway 2, unnecessary detection is avoided, thereby preventing a reduction in the availability rate of the elevator.

Further, since the light emitters 7 are arranged in the vicinity of the lower ends of the vertical frames 5, and the light receivers 8 are arranged on the lower surface of the upper frame 6, it is possible for the detection lights from the light emitters 7 to be efficiently received by the light receivers 8.

Further, when the obstruction detection signal is received before the door opening operation is started, the alarm is issued from the alarm device 12 and then the door opening operation is started, so that it is possible to prevent an obstruction from being caught between the vertical frame 5 and the car door 3.

Furthermore, since the alarm is an announcement to the effect that the door opening operation is to be started, it is possible to more reliably prevent an obstruction from being caught between the vertical frame 5 and the car door 3.

Further, when the obstruction detection signal is received also after the completion of the alarm, the door opening operation is started at a speed lower than the normal door opening speed, so that it is possible to more reliably prevent an obstruction from being caught between the vertical frame 5 and the car door 3.

Further, when the obstruction detection signal is received during the door opening operation, the door opening operation is temporarily stopped, which also helps to prevent an obstruction from being caught between the vertical frame 5 and the car door 3.

Furthermore, when the obstruction detection signal is received during the door opening operation, the door opening operation is temporarily stopped for a pre-set period of time, so that, even when an obstruction is caught between the vertical frame 5 and the car door 3, it is possible to remove the obstruction while the door opening operation is temporarily stopped.

Further, after the temporary stopping of the door opening operation, the door opening operation is resumed at a speed lower than the normal door opening speed, whereby it is possible to more reliably prevent an obstruction from being caught between the vertical frame 5 and the car door 3.

Further, after the temporary stopping of the door opening operation, the door opening operation is resumed while causing the alarm device 12 to issue the alarm, so that it is possible to more reliably prevent an obstruction from being caught between the vertical frame 5 and the car door 3.

EMBODIMENT 2

Figure 4:
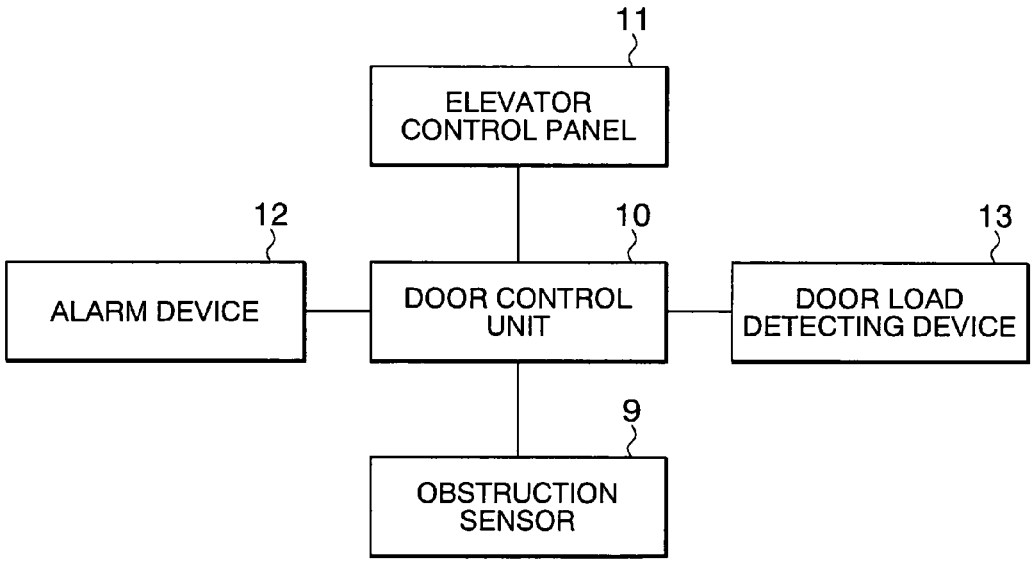
FIG. 4 is a block diagram showing an elevator door control device according to Embodiment 2 of this invention.

Next, FIG. 4 is a block diagram showing an elevator door control device according to Embodiment 2 of this invention. In the drawing, connected to the door control unit 10 is a door load detecting device 13 for outputting an excessive load detection signal when a load at the time of opening/closing of the car doors 3 and the landing doors exceeds a pre-set value. As the door load detecting device 13, a torque limiter provided in the door motor may be used, for example. An example of such a load detection method is disclosed in JP 7-97167 A.

The door control device of Embodiment 2 has the obstruction sensors 9, the door control unit 10, the alarm device 12, and the door load detecting device 13. Otherwise, this embodiment is of the same construction as Embodiment 1.

Figure 5:
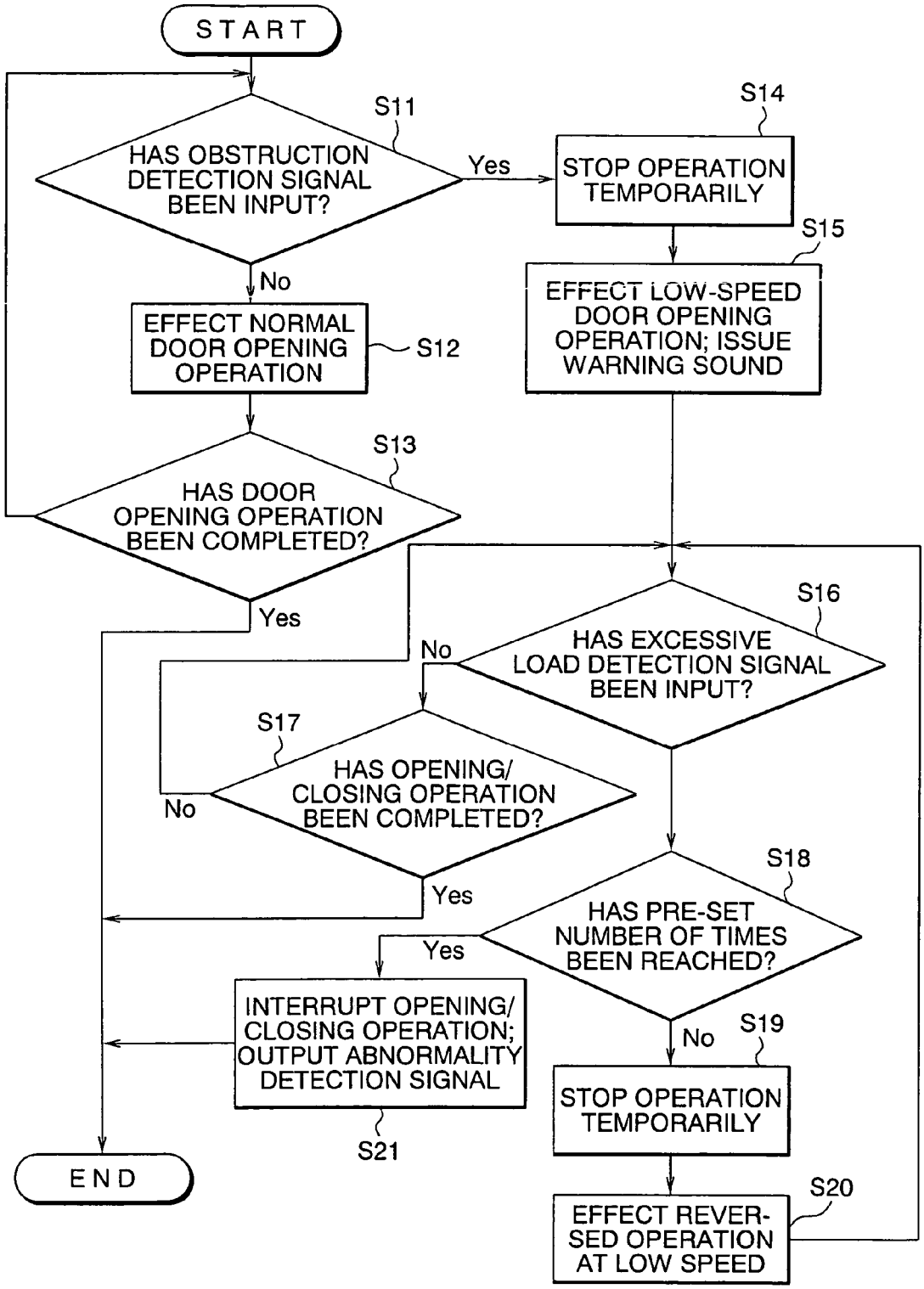
FIG. 5 is a flowchart illustrating the control process to be performed during door opening operation by the door control device of FIG. 4.

Next, the operation of the device of this embodiment will be described. FIG. 5 is a flowchart illustrating the control process to be performed by the door control device of FIG. 4 during door opening operation. The control process prior to the start of the door opening operation is the same as that of FIG. 2. Further, the procedures of step S11 to step S15 are the same as those of FIG. 3.

In Embodiment 2, when an obstruction detection signal has been input, and door opening operation is being conducted at a low speed while issuing an alarm sound (step S15), a judgment is made as to whether an excessive load detection signal has been input or not (step S16). If no excessive load detection signal has been input, the low-speed door opening operation is continued. Then, a judgment is made as to whether the door opening operation has been completed or not (step S17). If it has not been completed yet, the checking on the input on the excessive load detection signal is continued (step S16).

During the normal door opening operation, the number of times that the excessive load detection signal has been input before the completion of the door opening operation is counted. When the excessive load detection signal has been input, a judgment is made as to whether the number of times that the excessive load detection signal has been input has reached a pre-set number of times (step S18). If the pre-set number of times has not been reached yet, the door opening operation is temporarily stopped for a pre-set period of time (e.g., three seconds) (step S19). After the temporary stopping of the door opening operation, the operating directions of the car doors 3 are reversed, and door closing operation is started at a speed lower than the normal door closing speed (step S20).

Thereafter, a judgment is made again as to whether the excessive load detection signal has been input or not (step S16). When, as a result of the reversed operation, the input of the excessive load detection signal is ceased, the low-speed door closing operation is continued. Then, a judgment is made as to whether the door closing operation has been completed or not (step S16). If it has not been completed yet, the door closing operation is continued while continuously checking on the input of the excessive load detection signal. When the car doors 3 have been completely closed, the door control is terminated on a temporary basis.

In this state, if there is any other call registered, the car 1 is moved to a floor where the call is registered. When no call is registered, a passenger can depress a door opening switch inside the car 1 to open the car doors 3 and the landing doors.

When the excessive load detection signal has been input also after the reversed operation, the above operation is repeated until the number of times that the excessive load detection signal has been input reaches a pre-set number, and the operating directions for the car doors 3 and the landing doors are repeatedly reversed.

When the number of times that the excessive load detection signal has been detected reaches a pre-set number (e.g., three), the opening/closing operation for the car doors 3 and the landing doors is interrupted, and an abnormality detection signal is output to the exterior, such as the elevator control room, through the elevator control panel 11 (step S21).

In this elevator door control device, when the excessive load detection signal is received during the door opening operation, the number of times that the excessive load detection signal has been input before the completion of the opening/closing operation is counted. When the number of times of input reaches a pre-set number, the opening/closing operation is interrupted, and the abnormality detection signal is output, so that if an obstruction should be caught between the vertical frame 5 and the car door 3 to make the car doors 3 immovable, it is possible to reduce the load applied to the obstruction, and to take the requisite measures, such as sending of operators, at an early stage.

Further, until the number of times that the excessive load detection signal has been input reaches a pre-set number, the operating directions for the car doors 3 and the landing doors are reversed, so that, if foreign matter, such as dirt, is caught between the vertical frame 5 and the car door 3, it is possible to remove the foreign matter through reversed operation.

Further, by using the door load detecting device 13 in combination with the obstruction sensors 9, it is possible to more reliably prevent obstructions from being caught between the vertical frames 5 and the car doors 3, and to prevent obstructions from being caught between the vertical frames 5 and the car doors 3 during normal door opening operation.

While in Embodiment 2 the door load detecting device 13 is used in combination with the obstruction sensors 9, it is also possible to prevent obstructions from being caught solely by the door load detecting device 13 without using the obstruction sensors 9. In this case, the control flow consists of steps S16 through S21 in FIG. 5.

Further, while in the above example the light emitters 7 are arranged on the vertical frames 5, and the light receivers 8 are arranged on the upper frame 6, it is also possible to arrange the light receivers 8 on the vertical frames 5 and the light emitters 7 on the upper frame 6.

Further, the obstruction sensor is not restricted to an interception type optical sensor. For example, it is also possible to arrange a plurality of reflection type optical sensors, well-known proximity sensors, etc. on the vertical frames.

Furthermore, while in the above examples the obstruction sensors 9 are arranged in the doorway frame 4 of the car doorway 2, the obstruction sensor 9 may also be arranged on the doorway frame of the landing doorway. This makes it possible to prevent obstructions from being caught between the landing doors and the doorway frame. Further, it is also possible to arrange obstruction sensors on both the doorway frame 4 of the car doorway 2 and the doorway frame of the landing doorway.

Further, while in the above example this invention is applied to a door device of the type which opens at its center, this invention is also applicable to a door device of the type which opens on one side. In this case, the obstruction sensor may be provided solely on a door case side.

The invention claimed is:

1. An elevator door control device for use in an elevator apparatus with a doorway frame having first and second vertical frame walls and horizontal upper frame wall between the first and second vertical frame walls is located in each of a car doorway and a landing doorway, opening/closing operations of a car door for opening and closing the car doorway and opening/closing operations of a landing door for opening and closing the landing doorway being controlled by the elevator door control device, the elevator door control device comprising:

an obstruction sensor including a light emitter located on one of (i) the first and second vertical frame walls and (ii) the upper frame wall of at least one of the car doorway and the landing doorway and emitting detection light beams substantially along the first and second vertical frame walls, and a light detector on the other of (i) the first and second vertical frame walls and (ii) the upper frame wall for detecting the detection light beams, and detecting an obstruction proximate the first and second vertical frame walls and outputting an obstruction detection signal upon detection of any obstruction; and a door control unit for controlling the opening/closing operations in accordance with outputting of the obstruction detection signal.

2. The elevator door control device according to claim 1, wherein the light emitters are located proximate lower ends of the first and second vertical frame walls, and the light detectors are located on the upper frame wall.

3. An elevator door control device for use in an elevator apparatus with a doorway frame having a pair of vertical frame walls and an upper frame wall located between the vertical frame walls located in each of a car doorway and a landing doorway, opening/closing operations of a car door for opening and closing the car doorway and opening/closing operations of a landing door for opening and closing the landing doorway being controlled by the elevator door control device, the elevator door control device comprising:

an obstruction sensor for detecting an obstruction proximate the vertical frame walls of at least one of the car doorway and the landing doorway and outputting an obstruction detection signal in response;

an alarm device for issuing an alarm for a passenger; and a door control unit for controlling the opening/closing operations in accordance with outputting of the obstruction detection signal, wherein the door control unit, upon receiving the obstruction detection signal prior to beginning the door opening operation, causes the alarm device to issue an alarm before staring the door opening operation.

4. The elevator door control device according to claim 3, wherein the alarm is an announcement that the door opening operation is to start.

5. The elevator door control device according to claim 3, wherein the door control unit, upon receiving the obstruction detection signal, after completion of the alarm, causes the door opening operation to start at a speed lower than a normal door opening speed.

6. An elevator door control device for use in an elevator apparatus with a doorway frame having a pair of vertical frame walls and an upper frame wall located between the vertical frame walls located in each of a car doorway and a landing doorway, opening/closing operations of a car door for opening and closing the car doorway and opening/closing operations of a landing door for opening and closing the landing doorway being controlled by the elevator door control device, the elevator door control device comprising:

an obstruction sensor for detecting an obstruction proximate the vertical frame walls of at least one of the car doorway and the landing doorway and outputting an obstruction detection signal in response; and a door control unit for controlling the opening/closing operations in accordance with outputting of the obstruction detection signal, wherein the door control unit, upon receiving the obstruction detection signal during the door opening operation, stops the door opening operation temporarily.

7. The elevator door control device according to claim 6, wherein the door control unit, upon receiving the obstruction detection signal during the door opening operation, stops the door opening operation temporarily for a pre-set period of time.

8. The elevator door control device according to claim 6, wherein, after temporary stopping of the door opening operation, the door control unit resumes the door opening operation at a speed lower than a normal door opening speed.

9. The elevator door control device according to claim 6, further comprising an alarm device for issuing an alarm to a passenger, wherein, after temporary stopping of the door opening operation, the door control unit resumes the door opening operation while causing the alarm device to issue an alarm.

10. The elevator door control device according to claim 6, further comprising a door load detecting device outputting an excessive load detection signal when load on the door while opening/closing the car door and the landing door exceeds a pre-set value, wherein the door control unit reverses operating directions of the car door and the landing door upon receiving the excessive load detection signal, and the door control unit, upon receiving the obstruction detection signal and the excessive load detection signal during the door opening/closing operation, counts number of times that the excessive load detection signal has been input before completion of the opening/closing operation, interrupting the opening/closing operation and outputting an abnormality detection signal when the number of times reaches a pre-set number.

* * * * *